US005857887A

United States Patent [19]

Gotoh

[11] Patent Number: 5,857,887

[45] Date of Patent: Jan. 12, 1999

[54] METHOD OF MANUFACTURING A CATHODE-RAY TUBE

[75] Inventor: Hiroyuki Gotoh, Gihu, Japan

[73] Assignee: Sony Corporation, Tokyo, Japan

[21] Appl. No.: 743,675

[22] Filed: Nov. 6, 1996

[30] Foreign Application Priority Data

Nov. 8, 1995 [JP] Japan ..... 7-290066

[51] Int. Cl.[6] ..... H01J 9/18

[52] U.S. Cl. ..... 445/34

[58] Field of Search ..... 445/34, 36

[56] References Cited

U.S. PATENT DOCUMENTS 4,288,719 9/1981 Hernqvist .
4,410,310 10/1983 Halbrook .

*Primary Examiner*—Kenneth J. Ramsey
*Attorney, Agent, or Firm*—Hill & Simpson

[57] ABSTRACT

In a method of manufacturing a cathode-ray tube having an electron gun in which a voltage-dividing resistor is disposed, metal straps are disposed on the right and left of the electron gun. When metal deposited films for stabilizing a potential are formed on the inner wall of a neck portion of corresponding portions or the like by a radio-frequency heating means, metal deposited films of substantially the same thickness can be formed. In a cathode-ray tube in which a voltage-dividing resistor (9) is disposed on one glass bead (4) of a pair of glass beads (4) and (5) of an electron gun and metal straps (15) and (16) are disposed on a part of the glass beads (4) and (5) so as to include the voltage-dividing resistor (9), when metal deposited films for stabilizing a potential are formed on the inner wall of the neck portion, the surfaces of the glass beads and the surface of the voltage-dividing resistor by heating and evaporating the metal straps (15) and (16) by a radio-frequency induction heating means (26), the metal straps (15) and (16) are heated by the radio-frequency induction heating means (26) in which a metal plate (25) is disposed on the other glass bead (5) side at its portion opposing the metal strap (16).

6 Claims, 9 Drawing Sheets

METHOD OF MANUFACTURING A CATHODE-RAY TUBE

BACKGROUND OF THE INVENTION

The present invention relates to a method of manufacturing a cathode-ray tube (CRT).

In cathode-ray tubes, in each grid, an electron gun in which each grid is supported by a pair of glass beads is sealed into a neck portion.

A cathode-ray tube is treated by a process for preventing a potential within a CRT-assembly from being fluctuated due to stray charges charged on the inner wall of the neck portion opposing the CRT-assembly and the surface of glass bead on application of high voltage.

In this treatment, a metal ribbon serving as a metal strap, e.g., thin stainless steel material having a width of 0.1 mm and a thickness of 0.1 mm is wound around a part of a pair of glass bead, the thin stainless steel material is heated from the outer periphery of the neck portion by using a high-frequency (or radio-frequency) induction heating means and evaporated, and a metal deposited film is deposited on the inner wall surface of the neck portion of the corresponding portion and the surface of the glass bead.

The same assignee of this application has previously proposed a color cathode-ray tube shown in FIGS. 1 through 3.

As shown in FIG. 1 in an enlarged-scale, an electron gun 2 of a cathode-ray tube 1 comprises three cathodes $K_R$, $K_G$ and $K_B$ corresponding to red (R), green (G) and blue (B) arranged in line, a first grid $G_1$, a second grid $G_2$, a third grid $G_3$, a fourth grid $G_4$, a fifth grid $G_5$, a sixth grid $G_6$ and a seventh grid $G_7$ common to the three cathodes $K_R$, $K_G$, $K_B$ sequentially arranged and three beam apertures $\mathbf{3}_R$, $\mathbf{3}_G$, $\mathbf{3}_B$ for passing electron beams emitted from the three cathodes $K_R$, $K_G$ and $K_B$ defined in the first through seventh grids $G_1$ to $G_7$.

The first grid $G_1$ is applied with a voltage of 0 V, the second grid $G_2$ and the fourth grid $G_4$ are connected commonly and applied with a voltage of 700 V, the third grid $G_3$ and the fifth grid $G_5$ are connected commonly and applied with a voltage of 6 kV, the sixth grid $G_6$ is applied with a voltage ranging from 6 kV to 6.5 kV and the seventh grid $G_7$ is applied with a voltage of 25 kV which is an anode voltage, thereby resulting in the electron gun 2 being arranged as a bi-potential type electron gun.

Electron beams emitted from the cathodes $K_R$, $K_G$ and $K_B$ are converged on a fluorescent screen (not shown) through the beam apertures $\mathbf{3}_R$, $\mathbf{3}_G$, $\mathbf{3}_B$ of the grids $G_1$ through $G_7$.

As shown in FIG. 2, the grids $G_1$ through $G_7$ are integrally supported by a pair of glass beads 4 and 5 and this electron gun 2 is sealed into a neck portion IN of the cathode-ray tube 1.

When a high-voltage supplying contact member 6 integrally elongated from the seventh grid $G_7$ is brought in contact with an inner carbon film 7 connected to an anode button (not shown), the seventh grid $G_7$ is applied with an anode voltage of 25 kV, for example.

On the other hand, the voltage of 6 kV is applied to the third grid $G_3$ and the fifth grid $G_5$ through a voltage-dividing resistor 9. As shown in FIGS. 1 and 3, this voltage-dividing resistor 9 is formed such that an internal resistor 11 is formed on a ceramic base 10, electrode terminals $t_1$, $t_2$ and $t_3$ are formed on respective ends and an intermediate portion, the internal resistor 11 is coated with an insulating glass layer 12 except the terminals $t_1$, $t_2$ and $t_3$ and that the rear surface of the ceramic base 10 also is coated with the thin glass layer 12.

The voltage-dividing resistor 9 is disposed on one glass bead 4, the first electrode terminal $t_1$ thereof is connected to the seventh grid $G_7$, the second electrode terminal $t_2$ thereof is connected to the earth terminal, and the intermediate third terminal $t_3$ is connected through a common connection member 13 to the third grid $G_3$ and the fifth grid $G_5$.

In the cathode-ray tube 1 in which the above-mentioned electron gun 2 is sealed, metal straps 15 and 16 are wrapped around the electron gun 2 at its glass beads 4 and 5 on the portion corresponding to the fifth grid $G_5$, for example. One metal strap 15 is wound around the glass bead 4, including the voltage-dividing resistor 9, and the other metal strap 16 is wound around only the glass bead 5.

As shown in FIGS. 5 and 6, a radio-frequency induction heating means, i.e., radio-frequency heating coil 18 is disposed around the neck tube IN at its outer periphery corresponding to the metal straps 15 and 16. When this radio-frequency heating coil 18 is energized by a radio-frequency induction current 19, the radio-frequency heating coil 18 generates a uniform magnetic flux 20 so that an induction current is flowed to the metal straps 15 and 16 to heat and evaporate the metal straps 15 and 16. As a consequence, as shown in FIG. 7, metal deposited films 21 and 22 are formed on the neck portion IN at its portions corresponding to the inner wall, the surfaces of the glass beads and the surface of the voltage-dividing resistor. In this case, the metal deposited films 21 and 22 should be deposited in such a manner that the metal straps 15 and 16 may not be blown out by evaporation.

Since one metal strap 15 is wound around the glass bead 4 and the voltage-dividing resistor 9 and the other metal strap 16 is wound around only the glass bead 5 due to the structure of the electron gun 2, the metal straps 15 and 16 are not symmetrical and the portions which are in contact with the metal straps 15 and 16 are different in thermal conductivity. In other words, the metal strap 15 contacts with the glass bead 4 and the ceramic base 10 and the metal strap 16 contacts with only the glass bead 5 so that the metal deposited films 21 and 22 are not deposited symmetrically and uniformly.

Specifically, the metal straps (15, 16) are brought in contact with the surfaces of the glass beads and the ceramic base whose thermal conductivities are changed with a rise of temperature. As a consequence, since heat releases of metal straps are different, the metal straps reach a deposition temperature with different times, i.e., the metal strap having only the glass bead reach the deposition temperature earlier than the other metal strap. Thus, the metal deposited films 21 and 22 are not deposited uniformly and symmetrically.

Therefore, a freedom is small from a condition standpoint, one of metal deposited films is not deposited or one metal strap is blown out and cut.

SUMMARY OF THE INVENTION

In view of the aforesaid aspect, it is an object of the present invention to provide a method of manufacturing a cathode-ray tube in which left and right different metal straps are uniformly heated by a radio-frequency induction heating means so that left and right metal deposited films with substantially uniform thickness can be formed on the inner wall of a neck portion or the like.

According to the present invention, there is provided a method of manufacturing a cathode-ray tube having an electron gun which is sealed in a glass envelope. This method is comprised of the steps of fixing a plurality of cathodes and electrodes by at least two glass beads for fabricating an electron gun assembly, providing metal straps around each of glass beads, providing a voltage-dividing resistor which is electrically connected to the electrodes on one bead glass, sealing the electron gum assembly into a neck portion of the glass envelope, arranging a radio-frequency induction heater having a shielding means around the outer surface of the neck portion, the shielding means being opposed to the other glass bead, and heating the metal straps by the radio-frequency heater for metalizing the surface of the glass bead and the voltage-dividing resistor and an inner surface of the neck portion.

When the radio-frequency heating means with the metal plate partly disposed thereon is energized by a radio-frequency induction current, a magnetic flux density is changed by the metal plate and currents induced to the metal straps are different in the left and right. Specifically, an amount of induction current generated on the metal strap on the side corresponding to the metal plate is decreased. Therefore, one metal strap disposed on the side to which the metal plate is not opposed, accordingly, one metal strap disposed on the side including the voltage-dividing resistor and the other metal strap with only the glass bead are heated in a well-balanced fashion so that the metal deposited films of substantially the same thickness are formed, respectively.

DETAILED DESCRIPTION OF THE PREFERRED EMBODIMENT

A method of manufacturing a cathode-ray tube according to the present invention will hereinafter be described with reference to the drawings.

Figure 8:
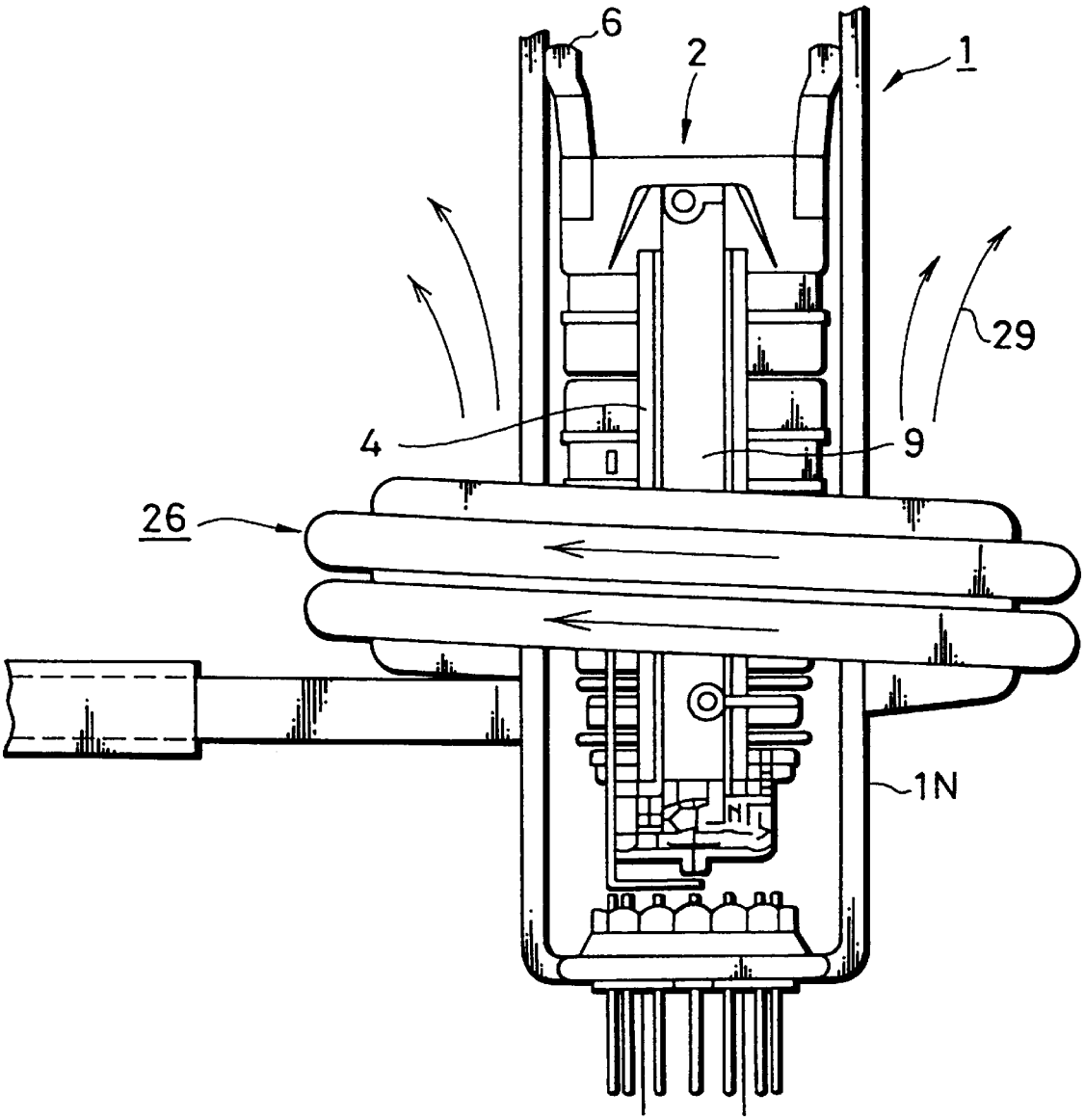
FIG. 8 is a cross-sectional view illustrating a method of manufacturing a cathode-ray tube according to an embodiment of the present invention.
Figure 9:
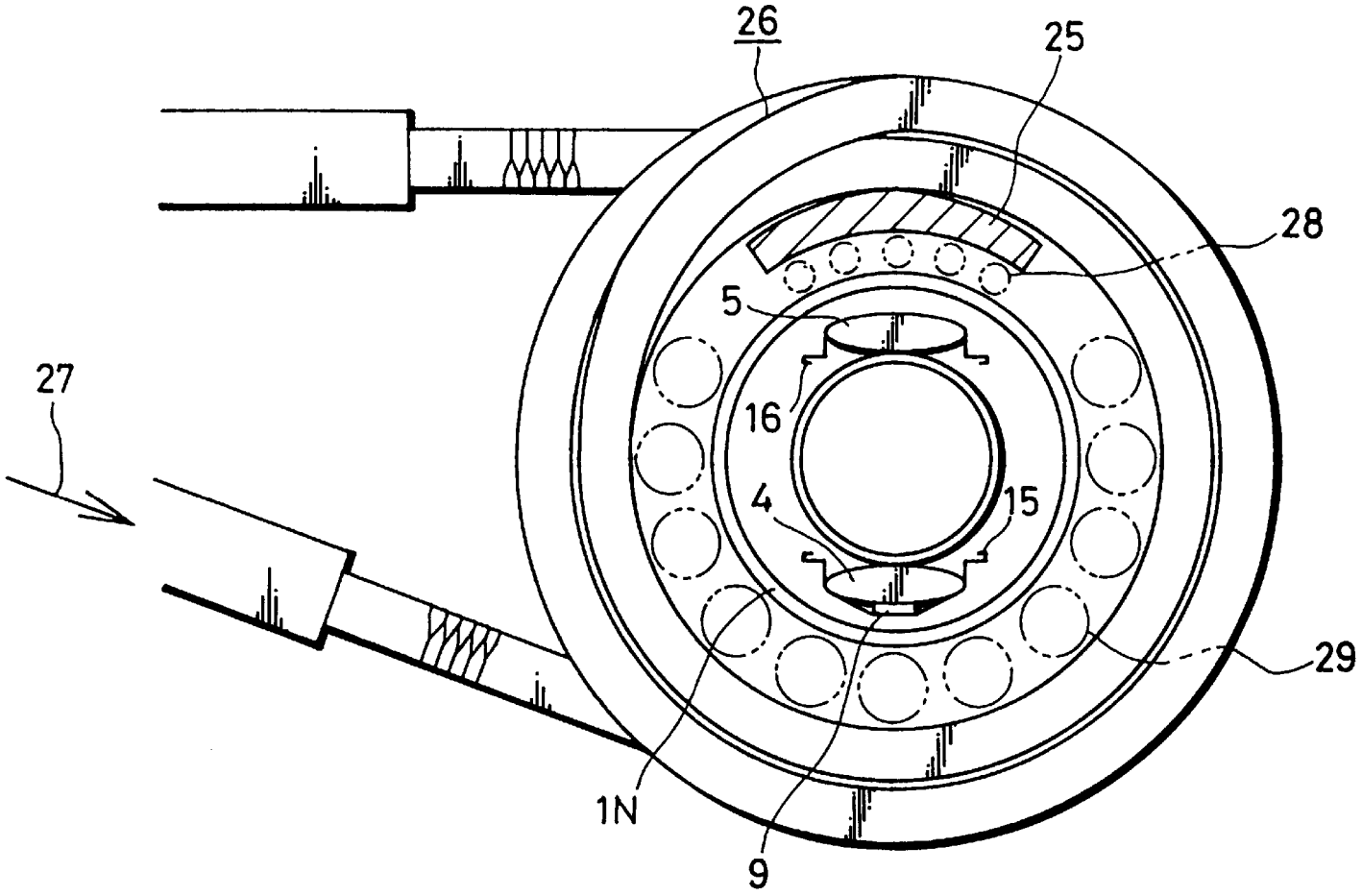
FIG. 9 is a cross-sectional view illustrating a method of manufacturing a cathode-ray tube according to the embodiment of the present invention.

FIGS. 8 and 9 are schematic diagrams used to explain a method of manufacturing a cathode-ray tube according to the present invention, i.e., method of heating metal straps wound around a part of glass beads of an electron gun.

A cathode-ray tube according to the present invention includes a similar cathode-ray tube described with reference to FIGS. 1 to 3.

Figure 1:
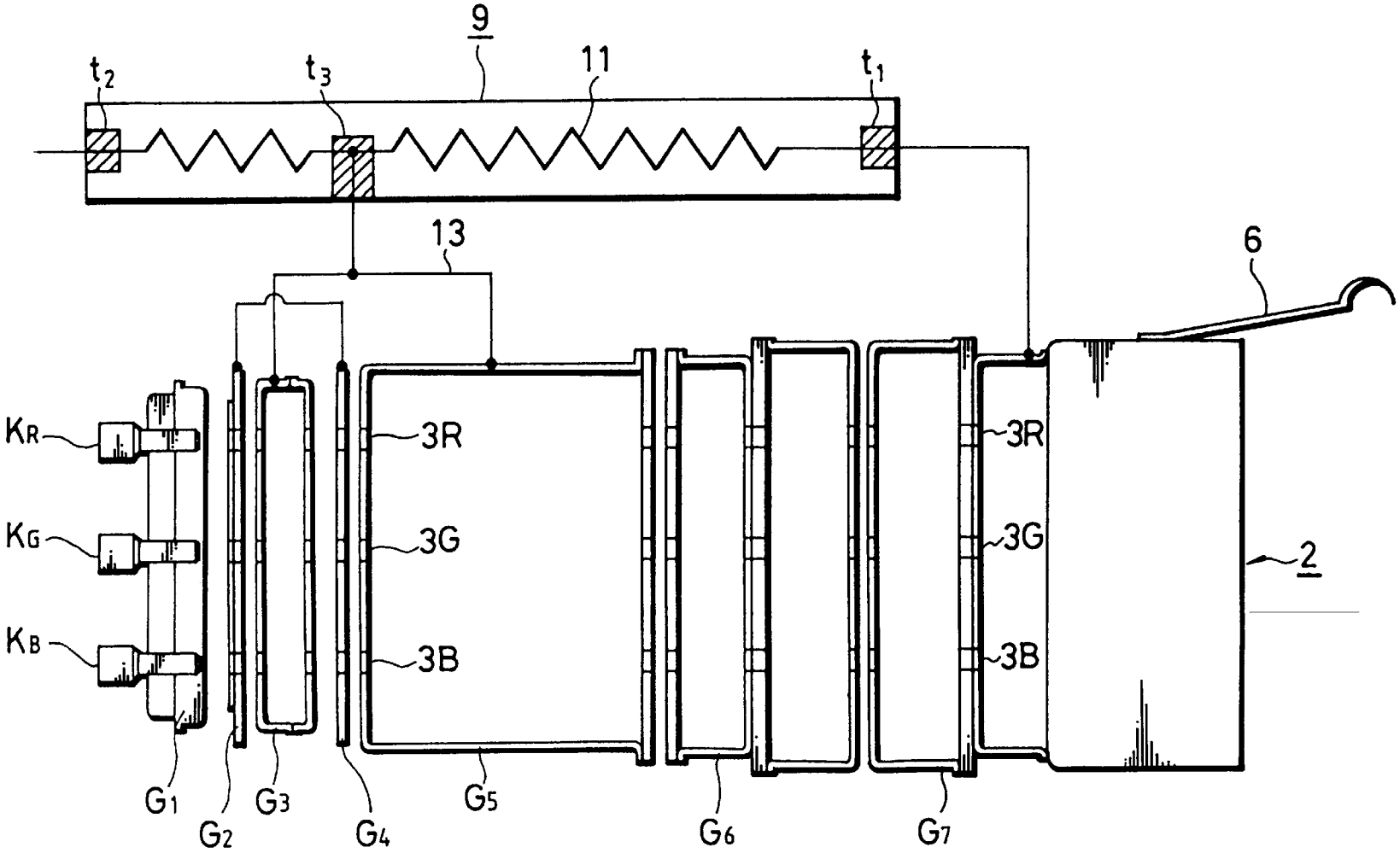
FIG. 1 is a schematic diagram showing an electron gun.

As earlier noted, as shown in FIG. 1 in an enlarged-scale, the electron gun 2 comprises the three cathodes $K_R$, $K_G$ and $K_B$ corresponding to red (R), green (G) and blue (B) arranged in line, the first grid $G_1$, the second grid $G_2$, the third grid $G_3$, the fourth grid $G_4$, the fifth grid $G_5$, the sixth grid $G_6$ and the seventh grid $G_7$ common to the three cathodes $K_R$, $K_G$, $K_B$ sequentially arranged and the three beam apertures $\mathbf{3}_R$, $\mathbf{3}_G$, $\mathbf{3}_B$ for passing electron beams emitted from the three cathodes $K_R$, $K_G$ and $K_B$ defined in the first through seventh grids $G_1$ to $G_7$ .

The first grid $G_1$ is applied with a voltage of 0 V, the second grid $G_2$ and the fourth grid $G_4$ are connected commonly and applied with a voltage of 700 V, the third grid $G_3$ and the fifth grid $G_5$ are connected commonly and applied with a voltage of 6 kV, the sixth grid $G_6$ is applied with a voltage ranging from 6 kV to 6.5 kV and the seventh grid $G_7$ is applied with a voltage of 25 kV which is an anode voltage, thereby resulting in the electron gun 2 being arranged as a bi-potential type electron gun. Electron beams emitted from the cathodes $K_R$, $K_G$ and $K_B$ are converged on a fluorescent screen (not shown) through the beam apertures $\mathbf{3}_R$, $\mathbf{3}_G$, $\mathbf{3}_B$ of the grids $G_1$ through $G_7$.

Figure 2:
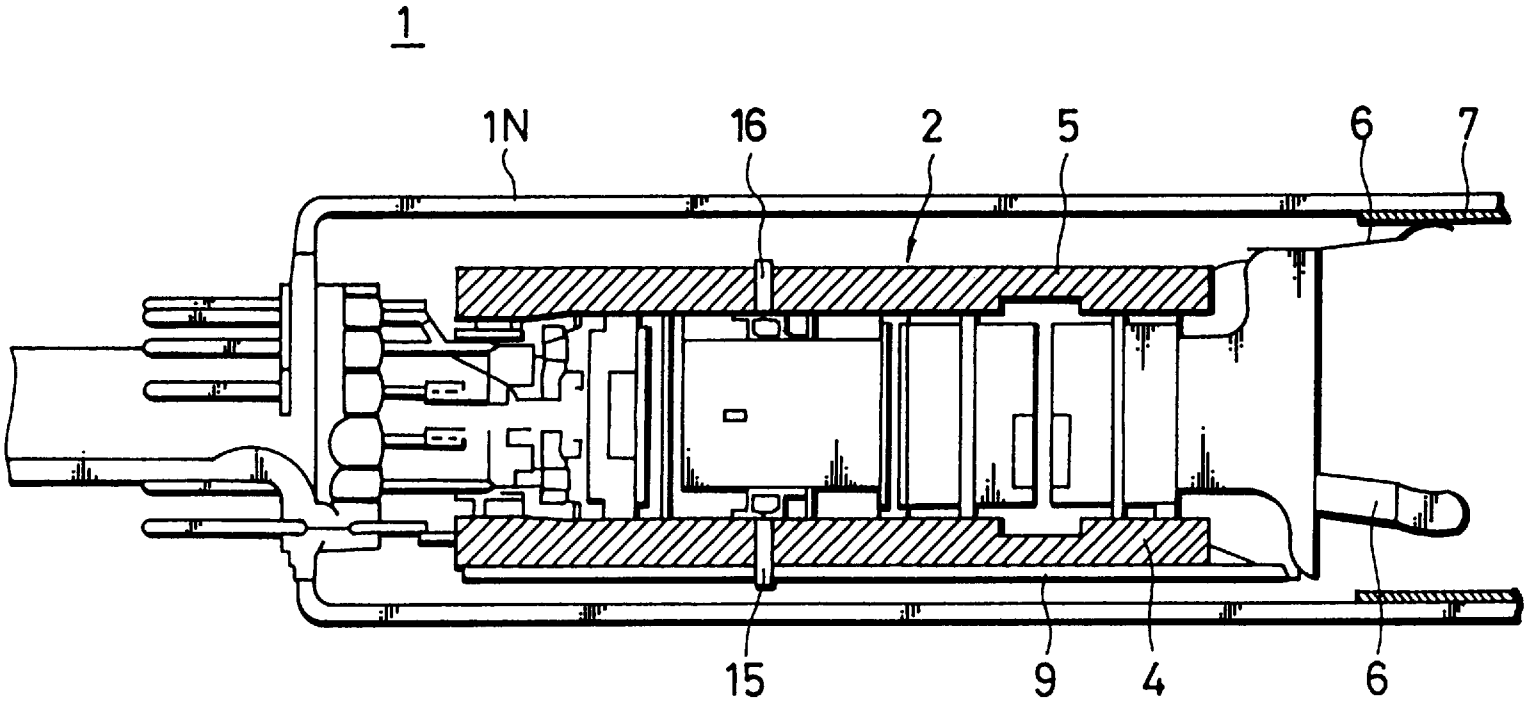
FIG. 2 is a cross-sectional view illustrative of a main portion of a cathode-ray tube to which the present invention is applied.
Figure 3:
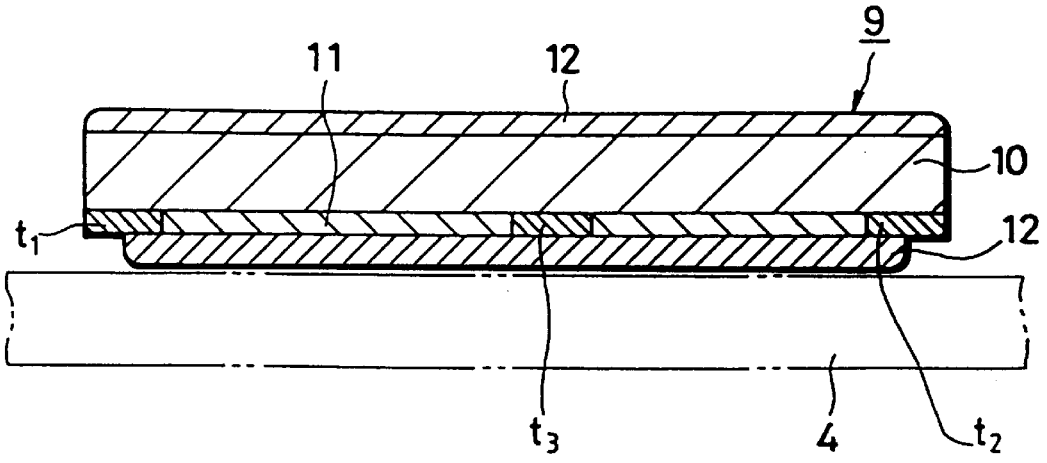
FIG. 3 is a schematic diagram showing a voltage-dividing resistor.
Figure 4:
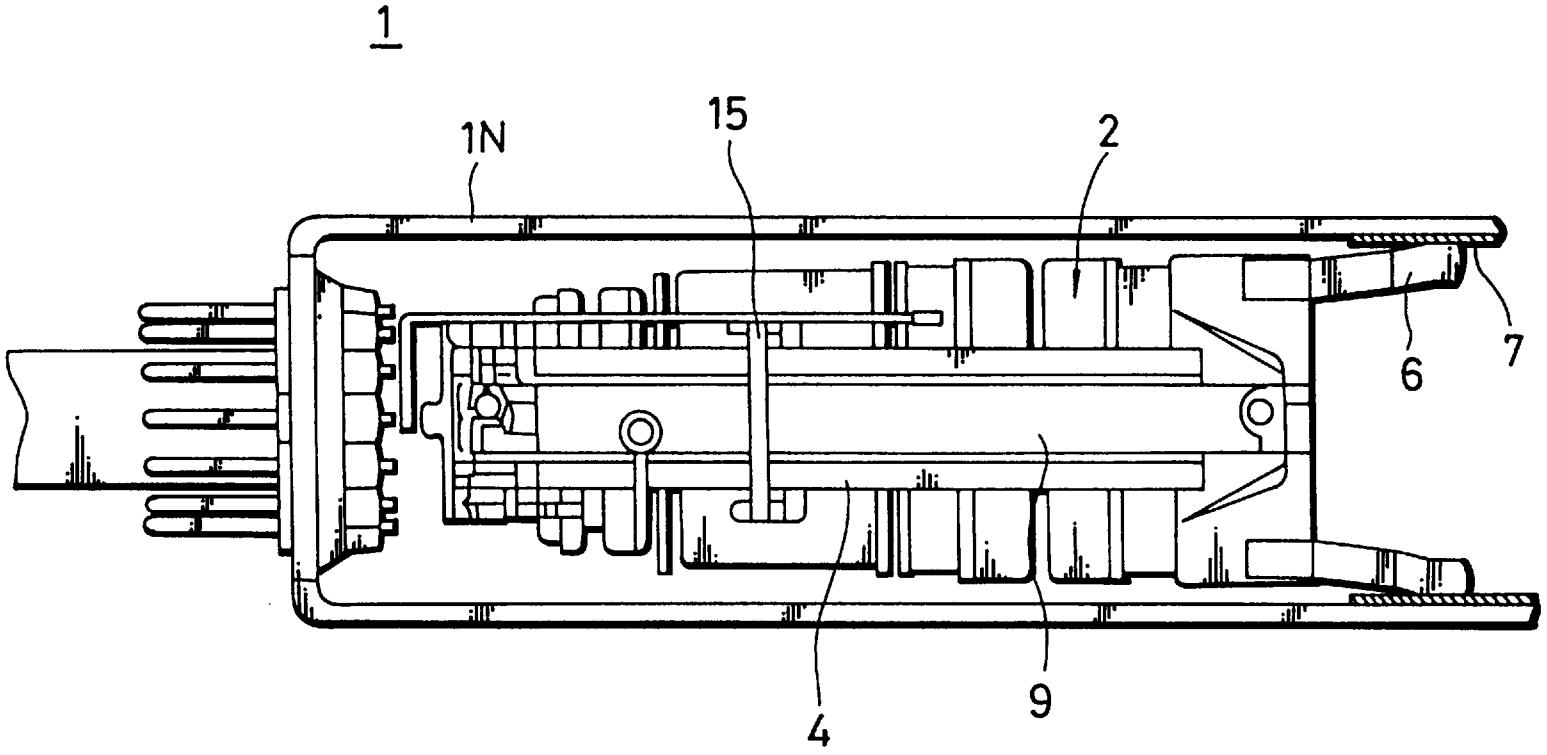
FIG. 4 is a cross-sectional view illustrating the main portion of the cathode-ray tube shown in FIG. 2 in the direction at a right angle of FIG. 2.
Figure 5:
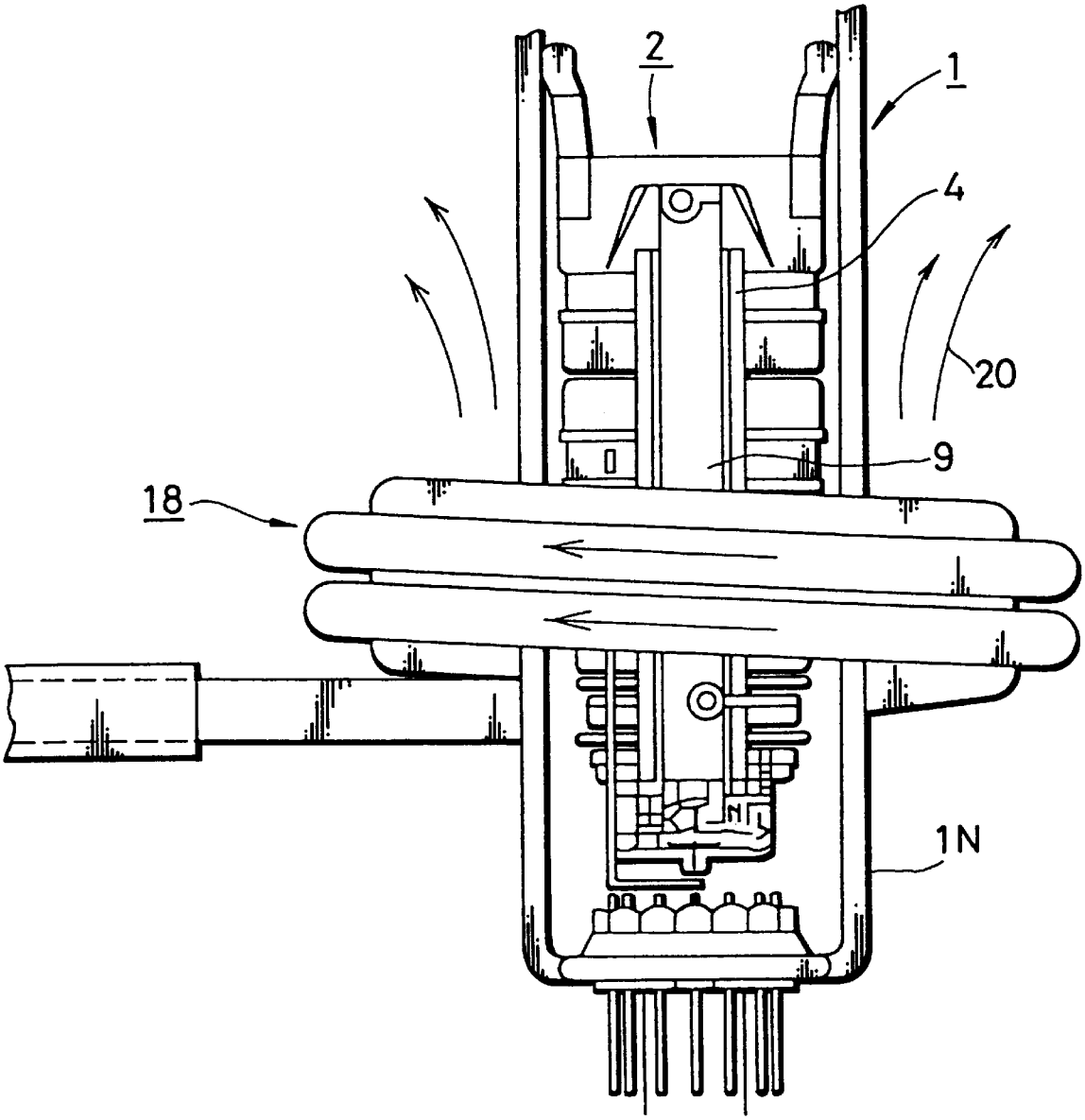
FIG. 5 is a schematic diagram showing a method of manufacturing a cathode-ray tube according to a comparative example.
Figure 6:
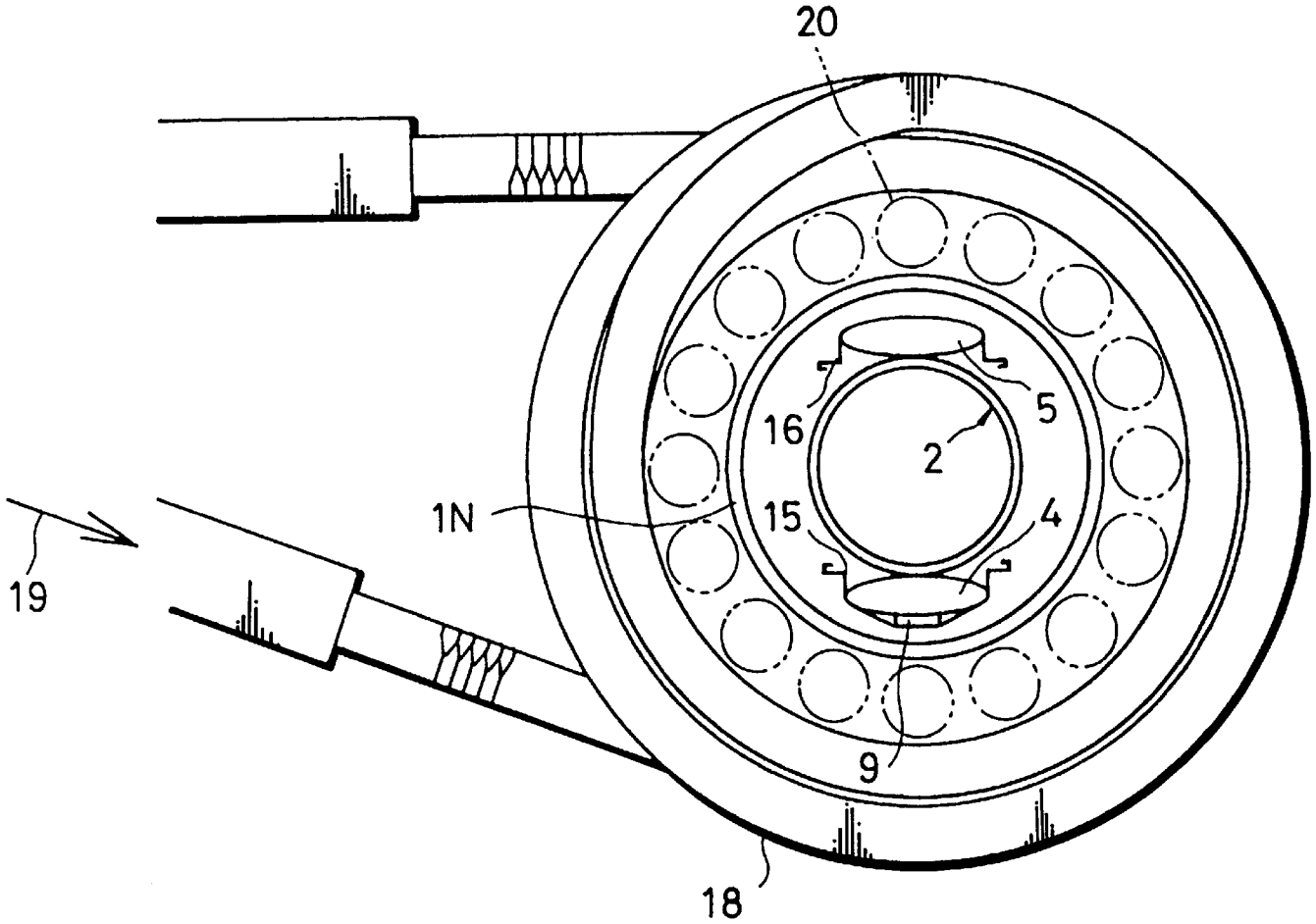
FIG. 6 is a cross-sectional view of FIG. 5.

As shown in FIGS. 2 and 4, the grids $G_1$ through $G_7$ are integrally supported by a pair of glass beads 4 and 5 and this electron gun 2 is sealed into the neck portion IN of the cathode-ray tube 1 under the condition that the voltage-dividing resistor 9 is disposed on one glass bead 4. When a high-voltage supplying contact member 6 integrally elongated from the seventh grid $G_7$ is brought in contact with the inner carbon film 7 connected to the anode button (not shown), the seventh grid $G_7$ is applied with an anode voltage of 25 kV, for example.

On the other hand, the voltage of 6 kV is applied to the third grid $G_3$ and the fifth grid $G_5$ through the voltage-dividing resistor 9. As shown in FIGS. 1 and 3, this voltage-dividing resistor 9 is formed such that the internal resistor 11 is formed on the ceramic base 10, the electrode terminals $t_1$, $t_2$ and $t_3$ are formed on respective ends and the intermediate portion, the internal resistor 11 is coated with the insulating glass layer 12 except the terminals $t_1$, $t_2$ and $t_3$ and that the rear surface of the ceramic base 10 also is coated with the thin glass layer 12.

The voltage-dividing resistor 9 is disposed on one glass bead 4, the first electrode terminal $t_1$ thereof is connected to the seventh grid $G_7$, the second electrode terminal $t_2$ thereof is connected to the earth terminal, and the intermediate third terminal $t_3$ is connected through the common connection member 13 to the third grid $G_3$ and the fifth grid $G_5$, whereby a voltage of 6 kV from the voltage-dividing resistor 9 is applied to the third grid $G_3$ and the fifth grid $G_5$.

Metal straps 15, 16 made of a thin stainless steel plate having a thickness of 0.1 mm and a width of 1 mm are wound around the electron gun 2 at its glass beads 4 and 5 on the portion corresponding to the fifth grid $G_5$, for example. Specifically, one metal strap 15 is wound around the glass bead 4 and the voltage-dividing resistor 9, and the other metal strap 16 is wound around only the glass bead 5.

According to the present invention, when the metal straps 15 and 16 of the cathode-ray tube 1 are heated and deposited, as shown in FIGS. 8 and 9, the metal straps 15 and 16 are heated by using a radio-frequency induction heating means, i.e., radio-frequency heating coil 26 in which a metal plate, e.g., a copper shield plate 25 is disposed on the side heated excessively, i.e., the other glass bead 5 in which a temperature rises quickly at its inner portion opposing the metal strap 16.

When the radio-frequency heating coil 26 is energized by a radio-frequency induction current 27, a density of magnetic flux generated by the copper shield plate 25 is changed. Specifically, the magnetic flux density becomes a small magnetic flux density 28 on the side opposing the copper shield plate 25 and becomes a large magnetic flux density 29 on the reflection side to which the copper shield plate 25 is not opposed, i.e., the voltage-dividing resistor 9 side.

Figure 7:
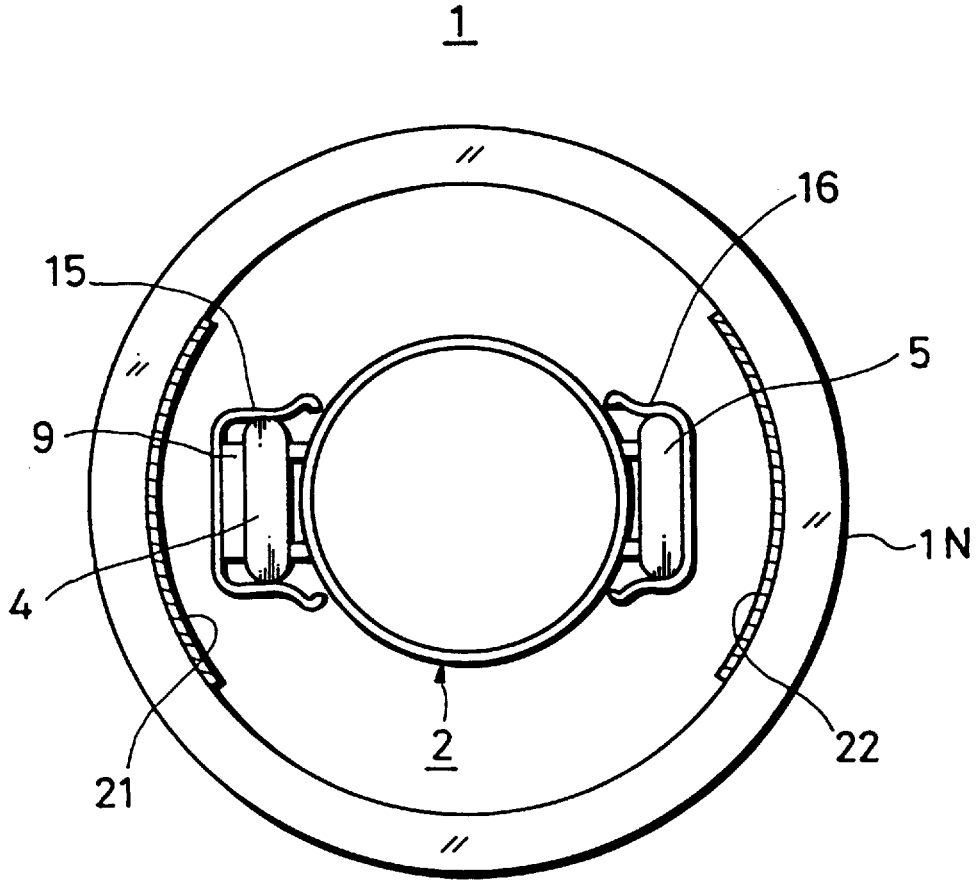
FIG. 7 is a cross-sectional view used to explain a cathode-ray tube.

Accordingly, an amount of induction current of the metal strap 16 on the glass bead 5 side decreases as compared with that of the metal strap 15 on the voltage-dividing resistor 9 side, whereby the states in which the left and right metal straps 15 and 16 are heated are well balanced. Thus, a difference of temperatures at which the two metal straps 15 and 16 are deposited can be reduced, and hence uniform metal deposited films (see the deposited films 21, 22 in FIG. 7) can be formed on the left and right inner walls of the neck portion, the surfaces of the glass beads and the surface of the voltage-dividing resistor.

The following table 1 shows measured deposited results obtained when cathode-ray tubes according to the inventive example and the comparative example were compared with each other.

TABLE 1

| | | Thermal | Comparative example | | Inventive example | |
|---|---|---|---|---|---|---|
| Metal straps | Attached side | conductivity $w \cdot m^{-2} \cdot k^{-1}$ | Temperature (°C.) | Result of deposition | Temperature (°C.) | Result of deposition |
| Thin stainless steel plate member 1.0 mm wide and 0.1 mm thick | Glass bead side | 1.5 | 1450 | Satisfactory | 1450 | Satisfactory |
| | Ceramic side (voltage-dividing resistor side) | 0.6 | 1250 | Unsatisfactory | 1350 | Satisfactory |

Study of the table 1 shows that, according to the inventive example, a difference of temperatures on the glass bead 5 side and the ceramic base 10 side forming the voltage-dividing resistor 9 was reduced, the metal deposited films (see the deposited films 21, 22 in FIG. 7) were formed substantially uniformly and measured deposited results at temperatures of 1450° C. and 1350° C. are both satisfactory.

As described above, according to the present invention, since the left and right different metal straps 15, 16 wound around the portions with different thermal conductivities are heated by the radio-frequency heating coil substantially uniformly, there can be formed the metal deposited films having substantially the same thickness.

Accordingly, it is possible to provide a cathode-ray tube in which charges can be prevented from being charged on the inner wall of the neck portion, the surfaces of the glass beads and the surface of the voltage-dividing resistor and in which potentials on these respective portions can be made stable.

While the present invention is applied to the cathode-ray tube having the electron gun in which three electron beams are traveled through the grids $G_1$ to $G_7$ and converged on the fluorescent screen as described above, a principle of the present invention may be applied to a cathode-ray tube having an electron gun with a voltage-dividing resistor in which three electron beams are crossed and diverged by a main electron lens and then converged on the fluorescent screen by a convergence means comprising four deflection electrode plates.

The method of the present invention is effective for controlling a temperature distribution in apparatus using a radio-frequency induction heating method and may be applied to a radio-frequency heating and a radio-frequency quenching.

According to the present invention, since the metal straps wound around the glass beads of the electron gun having the voltage-dividing resistor are heated by the radio-frequency induction heating means to substantially the same extent, the left and right deposited films for stabilizing a potential can be formed substantially uniformly. Therefore, it is possible to manufacture a cathode-ray tube which is highly reliable.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A method of manufacturing a cathode-ray tube having an electron gun which is sealed in a glass envelope comprising the steps of:

fixing a plurality of cathodes and electrodes by at least two glass beads for fabricating an electron gun assembly;

providing metal straps around each of glass beads;

providing a voltage-dividing resistor which is electrically connected to the electrodes on one bead glass;

sealing said electron gun assembly into a neck portion of said glass envelope;

arranging a radio-frequency induction heater having a shielding means around the outer surface of said neck portion, said shielding means being opposed to the other glass bead; and heating said metal straps by said radio-frequency heater for metalizing the surface of said glass bead and said voltage-dividing resistor and an inner surface of said neck portion.

2. A method of manufacturing a cathode-ray tube as recited in claim 1, wherein said shielding means is a copper plate.

3. A method of manufacturing a cathode-ray tube as recited in claim 1, wherein said metal straps are made of stainless steel.

4. A method of manufacturing a cathode-ray tube as recited in claim 1, wherein said metal straps have a width of approximately 1 mm.

5. A method of manufacturing a cathode-ray tube as claimed in claim 1, wherein said metal straps have a thickness of approximately 0.1 mm.

6. A method of manufacturing a cathode-ray tube as claimed in claim 1, wherein said voltage-dividing resistor comprises a contuctive pattern formed on an insulating plate, and said conductive pattern is covered with a coating insulator.

* * * * *